United States Patent [19]

Konose

[11] Patent Number: 4,764,044

[45] Date of Patent: Aug. 16, 1988

[54] LIQUID APPLICATOR WITH SLIDABLE PUMP MECHANISM

[75] Inventor: Yoshiomi Konose, Fujioka, Japan

[73] Assignee: Mitsubishi Pencil Co., Ltd., Tokyo, Japan

[21] Appl. No.: 947,937

[22] Filed: Dec. 31, 1986

[30] Foreign Application Priority Data

Jan. 9, 1986 [JP] Japan ..... 61-2641

[51] Int. Cl.[4] ..... B43K 8/02; A46B 11/02

[52] U.S. Cl. ..... 401/150; 401/151; 401/171; 401/205; 401/278; 401/279

[58] Field of Search ..... 401/150, 151, 170, 171, 401/188 A, 205, 206, 146, 149, 148, 270, 278, 279

[56] References Cited

U.S. PATENT DOCUMENTS

| | | | |
|---|---|---|---|
| 991,124 | 5/1911 | Ackerman | 401/150 |
| 1,392,369 | 10/1921 | Stoewsand | 401/150 |
| 2,425,143 | 8/1947 | Brubaker | 401/150 X |
| 2,516,542 | 7/1950 | Blackman | 401/148 |
| 2,603,188 | 7/1952 | McKay | 401/151 |
| 3,181,539 | 5/1965 | Aston | 401/188 A |
| 4,043,681 | 8/1977 | Funahashi | 401/205 X |

*Primary Examiner*—Steven A. Bratlie

*Attorney, Agent, or Firm*—Armstrong, Nikaido, Marmelstein & Kubovcik

[57] ABSTRACT

A writing instrument or an applicator of the invention is constructed of: a shaft sleeve main body having an application liquid reservoir therein; and an application member provided in a front end of the shaft sleeve main body to receive a liquid supplied from the liquid reservoir. The shaft sleeve main body comprises: an ink conduit member provided with a large-diameter piston portion, and a rod element which projects forward from the piston portion and is smaller in diameter than the piston portion while provided with a communication-hole; a cylinder member for slidably receiving the ink conduit member means for moving the cylinder member along the axial line of the shaft sleeve main body; means for biasing both the cylinder member and the ink conduit member so as to be separated from each other; and a hole for the application member, connected to a front end portion of said ink conduit member, which front end portion projects from the cylinder member.

8 Claims, 3 Drawing Sheets

LIQUID APPLICATOR WITH SLIDABLE PUMP MECHANISM

BACKGROUND OF THE INVENTION

1. Field of the Invention

The present invention relates to a liquid applicator for liquid cosmetic such as a nail polish and the like, or a writing instrument such as a marking pen and the like employing a liquid ink and having a construction in which a liquid is guided to be fed from a liquid reservoir provided inside a shaft sleeve of the instrument to a brush or a pen core provided in a front portion of such shaft sleeve of the instrument.

2. Description of the Prior Art

In general, such liquid applicator of a conventional type is provided with a valve unit for controlling a liquid in its flow rate. An opening/closing operation of such valve unit is conducted by means of a push-out member provided in a rear end of a shaft sleeve of the applicator.

However, the conventional liquid applicator provided with such valve unit suffers from the following problem. Namely, when a liquid with a high viscosity is employed in the applicator, it is difficult for such liquid to pass through the valve unit, so that feeding of such liquid to an application member of the applicator can not be conducted smoothly. As a result, a user of such applicator can not conduct his application work swiftly, i.e., his application work with the use of such applicator takes time; too much time. In addition, the conventional applicator requires changes of the user's fingers in their positions on the applicator when the supply of the liquid to the application member of the applicator is conducted, and cause the application work to be interrupted. This is another problem inherent in the conventional applicator.

SUMMARY OF THE INVENTION

It is an object of the present invention to resolve the above problems, to make it possible to provide a novel liquid applicator.

According to the present invention, there is provided:

In a writing instrument or an applicator comprising: a shaft sleeve inside which a reservoir for receiving an application liquid is disposed; and an application member provided in a front end of said shaft sleeve and receiving said application liquid supplied from said reservoir; the improvement comprising:

an ink conduit member provided with a large-diameter piston portion positioned at its rear end, a rod member projected forward from a large-diameter piston portion the rod being smaller in diameter than the large-diameter piston portion, and a communication-hole opening in both a front end and an outer peripheral surface of said rod member and containing a check valve unit therein;

a cylinder member for slidably receiving said ink conduit member therein so as to hermetically project forward a front end portion of said ink conduit member, said cylinder member being slidably and hermetically received in said shaft sleeve and having a length enabling said ink conduit member to project said piston portion thereof fully out of said cylinder member when said cylinder member is positioned at its most forward position relative to said ink conduit member to make it possible that an interior space of said cylinder member communicates with an ambient space;

means for moving said cylinder member relative to said shaft sleeve along its axial line;

means for biasing said cylinder member and said ink conduit member so as to be separated from each other; and a holder for receiving said application member, said holder being connected to a front end portion of said ink conduit member projected from said cylinder member, to make it possible that an interior space of said holder communicates with said communication-hole of said ink conduit member.

In such writing instrument or applicator of the present invention: said check valve unit is provided with a valve seat provided inside said communication-hole, a movable ball to be seated on said valve seat and a means for urging said ball in a uni-direction, which check valve is preferably opened under the influence of a pressurized condition of said application liquid supplied from said reservoir;

said means for urging said ball in said unidirection may be a coiled spring;

said ink conduit member is reduced in diameter sequentially two times along its axial line toward a front end thereof to form two shoulder portions between which may be opened an end of said communication-hole;

means for hermetically and slidably keeping contacts one of which is between said ink conduit member and said cylinder member, the other of which contacts is between said cylinder and said shaft sleeve, are preferably O-rings;

said means for moving said cylinder member relative to said shaft sleeve along its axial line may be constructed of: a ring element provided with at least one supporting leg which is radially and inwardly projected from said ring element, and at least one slit provided in a front end of said shaft sleeve for slidably receiving said leg of said ring element therein; and said means for biasing said cylinder member and said ink conduit member so as to be separated from each other may be a coiled spring mounted on a minimum-diameter front end portion of said ink conduit member so as to be supported between one of said shoulder portions of said ink conduit member and a bottom wall of said cylinder member.

Any component of the writing instrument or applicator of the present invention may be constructed of a conventional part or material.

DESCRIPTION OF THE PREFERRED EMBODIMENT

The present invention will be hereinbelow described in detail with reference to the drawings illustrating a marking pen as an embodiment of the present invention. It is natural that the present invention is not limited to this embodiment.

Figure 4:
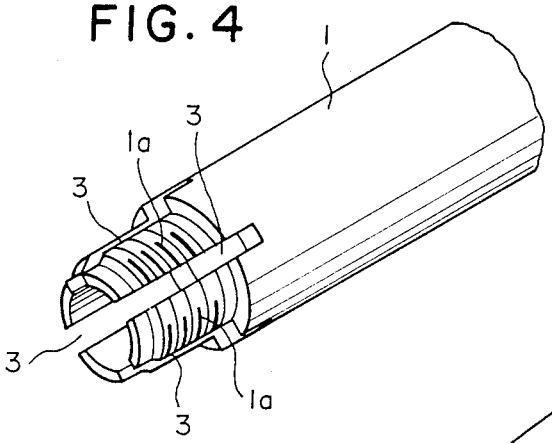
FIG. 4 is a perspective view of a front end portion of the embodiment shown in FIG. 1.
Figure 5:
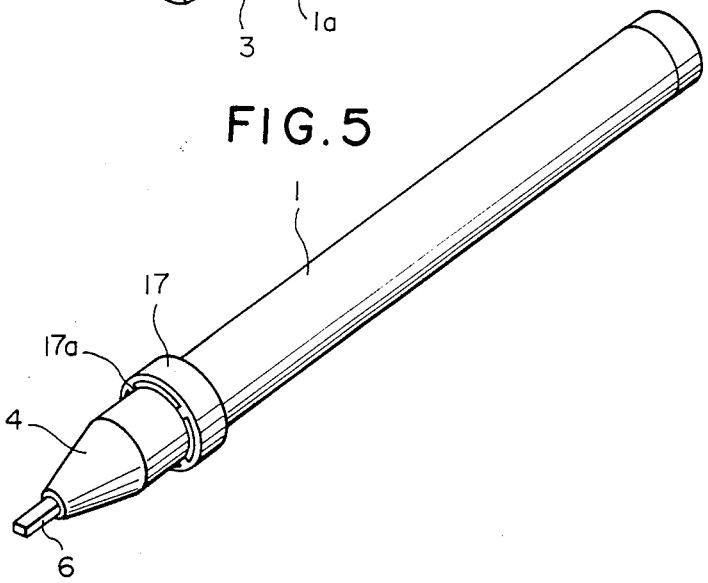
FIG. 5 is a perspective view of the whole of the embodiment shown in FIG. 1.

In the drawings: the reference numeral 1 denotes a shaft sleeve of the marking pen, made of synthtic resins; and 2 a liquid reservoir formed in a hollow rear portion of such shaft sleeve 1. As clearly shown in FIG. 4, a front end of the shaft sleeve 1 is slightly reduced in its outer diameter to form a small-diameter portion 1*a* which is threaded. At least one slit 3 is formed in the front end portion of the shaft sleeve 1 to extend from a front end of the shaft sleeve to a position slightly behind a rear end of the small-diameter portion 1*a* along an axial line of the shaft sleeve 1 by a predetermined length. If the number of the slit 3 is plural, such plurality of the slits 3 are angularly spaced apart from each other at suitable intervals in a cross section of the shaft sleeve 1.

Figure 1:
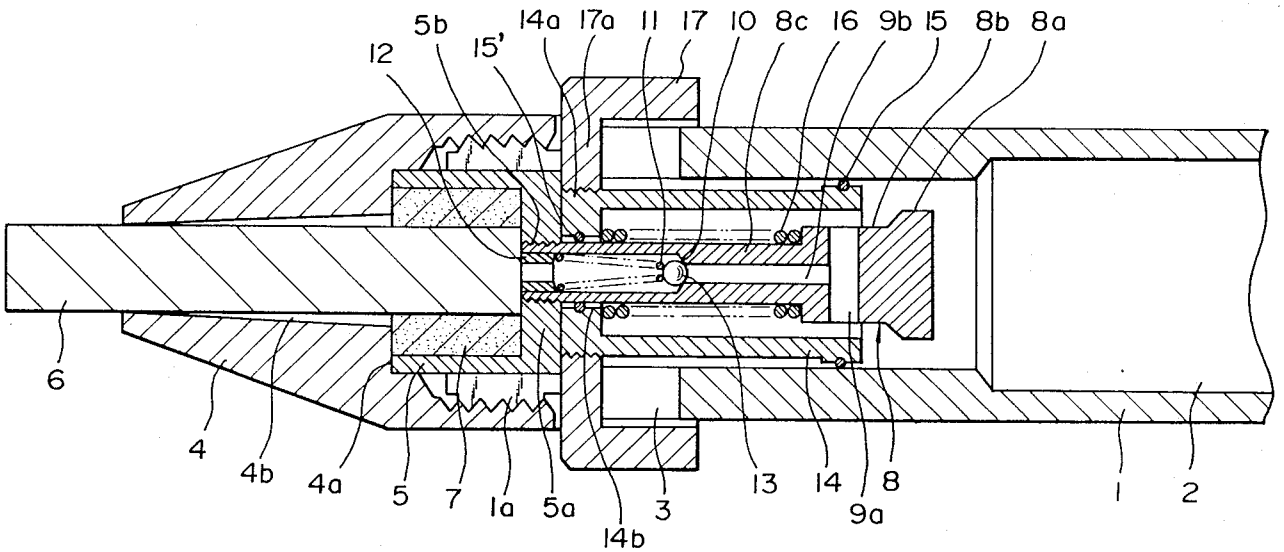
FIG. 1 is a longitudinal sectional view of a front portion of the embodiment of the present invention in a condition in which the valve is closed.

In FIG. 1, the reference numeral 4 denotes a tapered cylindrical front shaft provided with a thick portion inner wall of which is threaded to provide a female-screw portion through which the front shaft 4 is threadably mounted on a front end portion of the shaft sleeve 1.

A front portion of a bore inside the small-diameter portion 1*a* is enlarged in diameter to provide a shoulder portion 1*b*. An innermost portion of a bore inside the front shaft 4 is reduced in diameter to provide a shoulder portion 4*a*.

When the front shaft 4 is threadably mounted on the front end portion of the shaft sleeve 1, a holder 5 in which a rear end portion of an application member 6 made of fibrous or porous material providing a capillarity is held is clamped between these shoulder portions 4*a* and 1*b*.

The holder 5 has a cup-like shape with a bottom 5*a* in a center of which is provided a threaded hole 5*b* through which the front end portion of the ink conduit member 8 is threadably connected with the holder 5.

The holder 5 holds firmly the application member 6 therein through a resilient and porous cylindrical liquid-absorber element 7 provided inside the holder 5, to make it possible to prevent the application member 6 from easily dropping from the holder 5 and to position the application member 6 in a center of the holder 5, so that a rear end of the application member 6 abuts on the bottom 5*a* of the holder 5 to close the threaded hole 5*b* thereof.

A front end portion of the application member 6 passes through a central through-hole 4*b* of the front shaft 4 to project forward from a front end of the front shaft 4.

The front end of the ink conduit member 8 is threadably and fixedly connected with the holder 5 in its through-hole 5*b* of the bottom 5*a* of the holder 5, and the ink conduit member 8 is housed in the shaft sleeve 1.

The ink conduit member 8 has a cylindrical column-like shape and is sequentially reduced in its outer diameter two times along its axial line to provide: a large-diameter piston portion 8*a* having a largest diameter and shortest axial length; a middle-diameter portion 8*b* having a middle diameter and a middle axial length; and a small-diameter portion 8*c* having a smallest diameter and a longest axial length, a front portion of which small-diameter portion 8*c* is threaded to provide a male-screw portion which is threadably connected with the threaded hole 5*b* of the holder 5.

In the middle-diameter portion 8*b* of the ink conduit member 8 is provided a through hole 9*a* extending in a direction substantially perpendicular to the axial line of the ink conduit member 8. Communicated with such through-hole 9*a* is a communication-hole 9*b* extending to the front end of the ink conduit member 8.

In a substantially central portion of the communication-hole 9*b* is provided a shoulder portion 10 in front of which the communication hole 9*b* is enlarged in diameter so that the shoulder portion 10 acts as a valve seat.

In such enlarged portion of the communication-hole 9*b* is inserted a coiled spring 11 which is prevented from dropping out of the communication-hole 9*b* by means of a spring-support 12 and urges a ball 13 to the valve seat 10.

The reference numeral 14 denotes a cup-like member 14 for receiving the ink conduit member 8 therein. The member 14 is fully opened in its one end while provided with a bottom portion 14*a* in the other end thereof. In a central portion of the bottom portion 14*a* of the member 14 is provided a hole 14*b* which is slightly larger in diameter than the small-diameter portion 8*c* of the ink conduit member 8. An inner diameter of the member 14 is slightly larger than an outer diameter of the large-diameter piston portion 8*a* of the ink conduit member 8 so as to make it possible that the large-diameter piston portion 8*a* slidably reciprocates in the bore of the member 14 substantially without any looseness.

An outer peripheral surface of the bottom portion 14*a* of the member 14 is threaded to provide a male-screw portion with which is threadably connected a ring element or a finger-contact ring 17.

The finger-contact ring 17 is provided with at least one supporting leg 17*a* having a predetermined length, which leg 17*a* is radially and inwardly projected from one end portion of a peripheral portion of the finger-contact ring 17. A front end of the supporting leg 17*a* has a configuration corresponding to a part of an outer peripheral surface of the member 14, and is threaded so as to be threadably connected with the male-screw portion of the member 14. Through such supporting leg 17*a*, the finger-contact ring 17 is mounted on the cylinder 14.

The supporting leg 17*a* is positioned in a position corresponding to that of the slit 3 provided in the front end portion of the shaft sleeve 1, to make it possible that the supporting leg 17*a* is slidably inserted into the slit 3 of the shaft sleeve 1.

As shown in FIG. 1, the member 14 is shorter in axial length than the total length of the small-diameter portion 8*c* and the middle-diameter portion 8*b* of the ink conduit member 8 except for the male-screw portion of the small-diameter portion 8*c*. Namely, when the ink conduit member 8 is inserted into the member 14 so that the member 14 is placed in its most forward position relative to the ink conduit member 8, the large-diameter piston portion 8*a* of the ink conduit member 8 extends axially beyond the member 14.

The ink conduit member 8 is inserted into the member 14 on which is previously threadably mounted the finger-contact ring 17, in a condition that the coiled spring 16 is already mounted on the small-diameter portion 8*c* of the ink conduit member 8, so that the front end portion of the small-diameter portion 8*c* is projected forward from the through-hole 14*b* of the member 14. Under such circumstances, the holder 5 is threadably mounted on the front end of the small-diameter portion 8*c* of the ink conduit member. In an inner peripheral surface of the through-hole 14*b* of the member 14 is mounted an O-ring 15', so that the member 14 is brought into a hermetical contact with the small-diameter portion 8*c* of the ink conduit member 8. The coiled spring 16 is held between the shoulder portion of the middle-diameter portion 8*b* of the ink conduit member 8 and the bottom portion 14*a* of the member 14 to urge the member 14 to the holder 5.

In the holder 5 is mounted the application member 6 which constructs an assembly together with the holder 5, finger-contact ring 17, member 14 and the ink conduit member 8. The thus constructed assembly is inserted into the shaft sleeve 1 from its front end until the holder 5 abuts on the shoulder portion 1*b* provided in the inner wall of the shaft sleeve 1. At this time, the supporting leg 17*a* of the finger-contact ring 17 is inserted into the slit 3 of the front end portion of the shaft sleeve 1. The O-ring 15 mounted on the outer peripheral surface of the rear end portion of the cylinder 14 establishes a hermetical contact between the inner wall of the shaft sleeve 1 and the outer wall of the cylinder 14.

Then, the front shaft 4 is threadably mounted on the front end of the shaft sleeve 1, so that the holder 5 is fixed between the front shaft 4 and the shaft sleeve 1, whereby assembling of the assembly constructed of the application member 6, holder 5, finger-contact ring 17, member 14 and the ink conduit member 8, and the shaft sleeve is accomplished. In the thus constructed marking pen of the present invention, due to the hermetical effects of the O-rings 15 and 15', there is no possibility that the application liquid or ink is leaked.

In addition, the member 14 is slidable in the sleeve of the shaft 1 so long as the supporting leg 17*a* of the finger-contact ring 17 is slidable in the slit 3 of the front end portion of the shaft sleeve 1.

As shown in FIG. 1, the member 14 is abutted on the holder 5 under the influence of the coiled spring 16 when an outer force is not applied to the member 14, so that the large-diameter piston portion 8*a* of the ink conduit member 8 is outside the member 14 to make it possible that the ink flows from the reservoir 2 to the application member 6 through the through-hole 9*a* and the communication-hole 9*b*.

Figure 2:
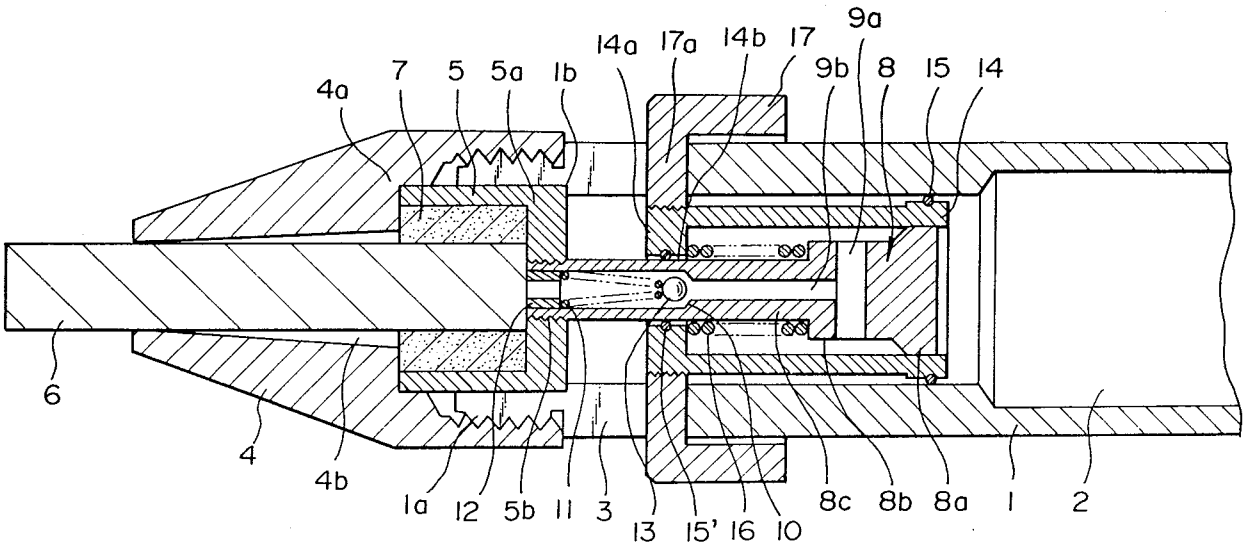
FIG. 2 is a longitudinal sectional view of the same embodiment in a condition in which the valve is opened.
Figure 3:
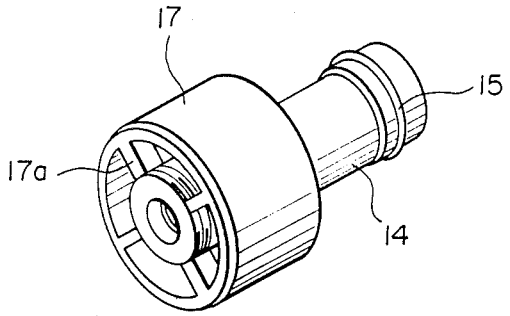
FIG. 3 is a perspective view of an assembly constructed of the cylinder member and the ring element of the embodiment of the present invention.

At this time, when it is required to forcibly supply the ink to the application member 6, it is sufficient for the user to pull the finger-contact ring 17 rearward until that the finger-contact ring 17 takes a position shown in FIG. 2. As a result of such pulling action, the large-diameter portion 8*a* of the ink conduit member 8 is inserted inside the member 14 and causes the volume of the enclosed space of the member 14 to decrease. Since there is substantially no looseness between the outer periphery of the large-diameter piston portion 8*a* and the inner wall of the member 14, a pressure in the enclosed space of the member 14 is increased to cause the ball 13 to move forward against the resilient force of the coiled spring 11, so that the valve is opened and the ink flows from the reservoir 2 to the application member 6 through the through-hole 9*a* and the communication-hole 9*b*.

When the finger-contact ring 17 is released from an outer force applied thereto, the member 14 returns to its initial position under the influence of the resilient force of the coiled spring 16. At this time, since the pressure of the enclosed space of the member 14 is decreased, the ball 13 is seated again on the valve seat to close the valve, so that any counterflow of the ink is prevented from occurring. When the large-diameter piston portion 8*a* of the ink conduit member 8 is projected outward from the member 14, the ink reservoir 2 is again communicated with the interior space of the member 14 to make it possible that the ink is supplied to the application member 6. When a large amount of ink is required to be supplied, the above action is repeated by again lifting the finger-contact ring.

In the embodiment of the present invention having the above construction, it is possible to forcibly supply the pressurized ink to the application member 6 by moving the finger-contact ring 17 which is placed in a position readily available to the user's fingers when holding the applicator in use. Consequently, even when the application liquid or ink with a high viscosity is employed, or consumption rate of the application liquid is considerably large, it is possible to swiftly and surely supply such liquid to the application member 6. In addition, such moving operation of the finger-contact ring 17 can be conducted while the user keeps his fingers on the sliding operation applicator in a writing condition, to enable the user to swiftly conduct the operation of the finger-contact ring 17. Therefore, there is no cumbersome act of changing the finger positions in such operation of the ring 17, and no interruption of the application work. Consequently, the ease of use of the applicator of the present invention is considerably increased.

What is claimed is:

1. In a writing instrument or an applicator comprising: a shaft sleeve inside which is disposed a reservoir for an application liquid; and an application member provided in a front end of said shaft sleeve to receive said application liquid supplied from said reservoir; the improvement comprising:

an ink conduit member provided with a large-diameter piston portion positioned at its rear end, a hollow rod portion projected forward from said large-diameter piston portion and being smaller than the same in diameter, and a communication-hole opening in both a front end and an outer peripheral surface of said hollow rod portion and containing a check valve unit therein;

a cup-like member for slidably receiving said ink conduit member therein, said cup-like member being slidably and hermetically received in said shaft sleeve and having a length enabling said ink conduit member to extend said piston portion thereof axially beyond said cup-like member when said cup-like member is positioned at its most forward position relative to said ink conduit member;

means for moving said cup-like member axially relative to said shaft sleeve;

means for biasing said cup-like member and said ink conduit member so as to be separated from each other; and a holder for receiving said application member, said holder being connected to a front end portion of said ink conduit member projected from said cup-like member, to make it possible that an interior space of said holder communicates with said communication-hole of said ink conduit member.

2. The writing instrument or applicator as set forth in claim 1, wherein: said check valve unit includes a valve seat inside said hollow rod portion, a movable ball to be seated on said valve seat and a means for urging said ball against said valve seat, which check valve unit is preferably opened under the influence of a pressurized condition within said cup-like member.

3. The writing instrument or applicator as set forth in claim 2, wherein: said means for urging sid ball against said valve seat is a coiled spring.

4. The writing instrument or applicator as set forth in claim 1, wherein: said ink conduit member is reduced in diameter sequentially two times along its axial line toward a front end thereof to form two shoulder portions between which to an end of said communication-hole.

5. The writing instrument or applicator as set forth in claim 1, wherein: said means for hermetically sealing between said ink conduit member and said cup-like member, and between said cup-like member and said shaft sleeve, are O-rings.

6. The writing instrument or applicator as set forth in claim 1, wherein: said means for moving said cup-like member relative to said shaft sleeve along its axis is constructed of: a ring element connected to said cup-like member and provided with at least one supporting leg which is radially and inwardly projected from said ring element, and at least one slit provided in a front end of said shaft sleeve for slidably receiving said supporting leg of said ring element therein.

7. The writing instrument or applicator as set forth in claim 1, wherein: said means for biasing said cup-like member and said ink conduit member so as to be separated from each other is a coiled spring.

8. A writing or applicator instrument which comprises:

(a) a main shaft-sleeve containing an application liquid reservoir;

(b) an application member mounted in a front end of said main shaft sleeve to receive and dispense application liquid from said reservoir;

(c) an ink conduit member having a increased diameter piston portion at one end thereof, a tubular rod portion extending axially from the other end, and at least one communication hole from the outer periphery of said ink conduit member disposed intermediate the piston portion and the tubular rod portion;

(d) a check-valve unit in the tubular rod portion of said ink conduit member;

(e) a cup-like member open to said reservoir for slidably receiving said ink conduit member with hermetic sealing means between the cup-like member and the ink conduit member, and between the cup-like member and the main shaft sleeve;

(f) means for moving said cup-like member axially relative to said main shaft sleeve;

(g) means for biasing said cup-like member away from said ink conduit member; and (h) said ink conduit member being fixed to said main shaft sleeve.

* * * * *